United States Patent [19]

Mochizuki et al.

[11] Patent Number: 4,653,728

[45] Date of Patent: Mar. 31, 1987

[54] APPARATUS FOR OPERATING AND TRANSFERRING MANHOLE COVER

[75] Inventors: Otohiko Mochizuki; Susumu Mochizuki, both of Shizuoka, Japan

[73] Assignee: Mochizuki Motor Co. Ltd., Japan

[21] Appl. No.: 822,049

[22] Filed: Jan. 24, 1986

[30] Foreign Application Priority Data

Jan. 31, 1985 [JP] Japan ..... 60-17652

[51] Int. Cl.[4] ..... B66F 11/00

[52] U.S. Cl. ..... 254/131

[58] Field of Search ..... 414/684.3; 280/47.27; 294/15, 17, 91; 254/120–123, 131.5, 131, 132, 129

[56] References Cited

U.S. PATENT DOCUMENTS 4,126,297 11/1978 Barnes ..... 254/131
4,488,706 12/1984 Kono ..... 254/131

FOREIGN PATENT DOCUMENTS 2403740 1/1974 Fed. Rep. of Germany ..... 254/131
2646646 4/1978 Fed. Rep. of Germany ..... 254/131

*Primary Examiner*—Robert C. Watson
*Attorney, Agent, or Firm*—Steinberg & Raskin

[57] ABSTRACT

An apparatus for operating and transferring a manhole cover is disclosed which is capable of being applicable to a manhole cover formed with any through-hole type operating hole and preventing the disengagement of the manhole cover from the apparatus. The apparatus includes a lever body having a pair of operating arms. The operating arms each have an eccentric hanging hook pivotally mounted thereon and a press member which is adapted to abutted against a manhole cover to horizontally support it during the lifting operation. The hanging hook comprises a vertical support member pivotally mounted on the operating arm to be pivotally moved in the longitudinal direction of the apparatus and a hanging member connected to the support member to inwardly extend therefrom in a manner to be deviated in the direction opposite to that of a point of force. The apparatus has a manhole cover lifting position which is deviated toward the press member with respect to the gravity line of the manhole cover.

14 Claims, 28 Drawing Figures

APPARATUS FOR OPERATING AND TRANSFERRING MANHOLE COVER

BACKGROUND OF THE INVENTION

1. Field of the Invention

This invention relates to an apparatus for operating and transferring a cover for a manhole for operating and inspecting piping, an electric cable, a tank or the like which is laid underground, and more particularly to a manhole cover operating and transferring apparatus which is adapted to efficiently lift a manhole cover provided with any operating hole of the through-hole type including that of the pick-hole type through the operating hole and then transfer it to another place. The present invention is not to carry out the separation of an edge of a manhole cover fixed to a support frame of a manhole due to clogging or the like from the support frame but is directed to a manhole cover operating and transferring apparatus for lifting and transferring a manhole cover of which an edge has been separated from the support frame.

2. Description of the prior Art

Recently, rapid progress in mechanization and laborsaving in civil engineering causes the physical strength of an operator to decline, resulting in the operator being often injured or sustaining an injury of the lumber vertebra such as a ruptured intervertebral disk, for example, during the operation of a manhole cover which requires the operator to exercise force of 50 kg or more. In general, manhole covers are formed with various kinds of operating holes which are adapted to be engaged with a distal end of lifting means such as a lifting lever to lift it.

A manhole cover operating and transporting apparatus was proposed which is constructed to handle a manhole cover formed with a particular operating hole in a laborsaving manner. However, the proposed operating and transporting apparatus is not adapted to be efficiently used for a manhole cover formed with an operating hole of the pick-hole type. Thus, a manhole cover provided with an operating hole of such pick-hole type and generally having a weight of 150–200 kg has been obliged to be operated in a manner such that a distal end of a pick is inserted into the operating hole and the manhole cover is lifted through the other end of the pick with the combined labor of at least two.

Now, an operating hole provided at a manhole cover will be described with reference to FIG. 1. As shown in FIG. 1, various kinds of operating holes are formed at a manhole cover depending upon the type of a manhole cover. In FIG. 1, reference numeral 20 designates a manhole cover and 22*a* to 22*f* designate operating holes formed at the manhole cover 20. In general, such operating holes each are typically arranged in the circumferential direction of a manhole cover and in the vicinity of a periphery of the cover. In FIG. 1, a single manhole cover 20 is provided with all kinds of operating holes 22 in a lump for the sake of brevity. It should be noted that normally one or two such types of operating holes are selectively provided at a manhole cover depending upon the type of a manhole cover. Operating holes designated by reference numerals 22*a* and 22*b* in FIG. 1 are of the type defined by the British Standards and are typically used in Japan. The operating holes 22*a* and 22*b* each are formed to have a central circular portion and a pair of extensions outwardly radially extending in the opposite directions therefrom, so that such a hanging hook as generally indicated by reference numeral 24 in FIG. 1 which is constructed to have projections 26 provided on both sides of a lower end thereof may be engagedly fitted at a lower portion thereof in the operating hole. More particularly, the operating holes 22*a* and 22*b* each are operated by means of the hanging hook 24 in a manner such that the hanging hook 24 is inserted through the operating hole 12*a* or 12*b* and rotated by an angle of about 90 degrees to securely support a lower side of the manhole cover 10 on the projections 26, and then the hanging hook 14 is upwardly moved to lift the manhole cover.

An operating hole of such type as designated by reference numeral 22*c* is formed to include a blind hole portion having a round bottom and a rectangular planar shape and a rod portion provided in a manner to be laid across the blind hole portion to separate the surface of the blind hole portion into two sections, so that a hanging hook as generally designated by reference numeral 28 in FIG. 1 may be operated with respect to the manhole cover 20 in a manner such that a hook portion 30 of the hanging hook 28 is engaged with the rod portion of the operating hole 22*c* to scoop the manhole cover 20 therethrough and then the hanging hook 28 is elevated to lift the manhole cover.

An operating hole designated by reference numeral 22*d* is of the so-called hatch-type and comprises a blind hole portion and a handle provided in a manner to be retractable with respect to the manhole cover 20. The operating hole 22*d* is likewise operated by a hanging hook of such type as indicated by reference numeral 28.

Operating holes indicated by reference numerals 22*e* and 22*f* in FIG. 1 are of the so-called pick-hole type and comprise through-holes formed into substantially circular and square shapes, respectively. A manhole cover provided with the operating holes 22*e* or 22*f* is operated in a manner such that at least two operators cooperate to lift the manhole cover by means of a pick which is inserted at a tip end thereof into the hole. An operating hole of the pick-hole type is generally provided at a manhole cover placed on a road onto which the weight of a motor vehicle is directly applied, because the other type operating hole of a larger size reduces the strength of the manhole cover to often cause the damage of the manhole cover due to the weight. In the United States, the ratio of application of a manhole cover formed with such a pick-hole type operating hole to a manhole cover amounts to 50% or more. In Japan, the pick-hole type operating hole is used for a manhole cover for a manhole for inspecting an electric cable.

Unfortunately, there was not developed a tool for efficiently lifting and transferring a manhole cover formed with such a pick-hole type operating hole. Accordingly, it was desired to develop an apparatus which is capable of effectively lifting and transferring a manhole cover having a pick-hole type operating hole while carrying out laborsaving.

The present invention is directed to an apparatus for efficiently lifting and transferring a manhole cover having pick-hole type operating holes provided opposite to each other in the diametric direction thereof wherein two lever members each having a wheel means and arranged to interpose a manhole therebetween are operated to lift the manhole, which is then transferred by means of the wheel means.

A conventional manhole operating apparatus of such type is disclosed in Japanese Utility Model Application Laid-Open Publication No. 60353/1973. The conventional apparatus is constructed in such a manner as shown in FIGS. 2A and 2B. More particularly, the manhole cover operating apparatus includes a lever body 100 comprising a pair of lever members 102 which are pivotally connected together at one end 104 thereof acting as a point of force so as to be pivotally moved with respect to each other and a wheel 106 rotatably mounted at the other end of each of the lever members 102. The apparatus also includes an operating arm 108 provided integral with each of the lever members 102 on an inside of the lever member in a manner to project in the direction opposite to that in which the lever body 100 carries out the operation of opening a manhole cover 20. Each of the operating arms 108 has a hanging hook member 112 pivotally mounted on a distal end thereof. The hanging hook member 112 is adapted to be engaged with an operating hole 22 of the manhole cover 20 to operate the manhole cover through the operating hole.

The manner of operation of the apparatus of FIG. 2 constructed as described above will be described now.

First, the hanging hook members 112 each are inserted into the operating hole 22 of the manhole cover 20 which is an operating hole defined in the British Standards and then turned by an angle of 90 degrees to engage projections provided at a lower end of the hanging hook member 112 with a lower surface of the manhole cover to support the manhole cover on the projections, so that it may be prevented from being released from the operating hole 22. Then, the one end of the lever body 100 defining the point of force 104 is pushed down to cause the lever body 100 to carry out a lever action in which the wheels 106 act as a point of support, resulting in a distal end of each of the operating arms 108 being upwardly moved. Thereafter, the manhole cover 20 held on the hanging hook members 112 is lifted and then transferred by means of the wheels 106.

However, the conventional manhole cover lifting and transferring apparatus shown in FIG. 2 has a disadvantage that it fails to securely hold a manhole cover during the operation because the hanging hook members 112 each are engaged with the manhole cover by merely abutting the projections of the hanging hook member against the lower surface of the manhole cover, so that there is a likelihood that the manhole cover is released and falls down from the apparatus due to a swing phenomenum of the manhole cover or the oscillation of the manhole cover during the lifting and transferring operation.

Also, the conventional apparatus causes the weight of the manhole cover applied to the hanging hook members 112 to generate inward moment as indicated at arrows A in FIG. 2B which acts on the whole lever body 100, resulting in the connection between the lever members 102 being substantially torsionally loaded. This requires the connection between the lever members 102 to have strength sufficient to resist such torsional load. However, this renders the provision of an operating knob means which is in parallel with operating holes of a manhole cover at the other end of the lever body highly difficult, to thereby fail to provide the apparatus with safe and efficient workability. This is exhibited especially when the operating holes are arranged away from an outer periphery of the manhole cover because such arrangement of the operating holes significantly increases the torsion moment.

Further, in the conventional manhole cover lifting and transferring apparatus, the operation of a manhole cover having operating holes provided away from an outer periphery thereof needs to arrange the hanging hook members 112 inwardly away from the wheels 106. This causes members for supporting the hanging hook members to substantially inwardly project from the lever body 100, resulting in a failure in the folding of the apparatus in a compact manner.

A still further important disadvantage encountered with the conventional apparatus is that it is applicable to a manhole cover formed with an operating hole defined in the British Standards. Accordingly, it fails to operate a manhole cover provided with the other through-hole type operating holes including a pick-hole type operating hole.

SUMMARY OF THE INVENTION

The present invention has been made in view of the foregoing disadvantage of the prior art.

Briefly speaking, in accordance with the present invention, an apparatus for operating and transferring a manhole cover is provided which is adapted to handle a manhole cover formed with at least one operating hole of the pick-hole type. The manhole cover operating and transferring apparatus of the present invention includes a lever body having one end which defines a point of force and having the other end on which wheel means are rotatably mounted thereon so as to define a point of support. On the lever body are mounted a pair of operating arms which extend in the direction opposite to that in which the lever body is moved during the operation of lifting a manhole cover and each of which has an eccentric hanging hook pivotally mounted on a distal end thereof. One of the operating arms and lever body is provided at a position thereof away from the distal end of each of the operating arms with press means which is abutted against an upper surface of the manhole cover during the operation of lifting it. The eccentric hanging hook comprises a vertical support member pivotally mounted at an upper end thereof on the distal end of each of the operating arms so as to be pivotally moved in the longitudinal direction of the manhole cover operating and transferring apparatus and a hanging member mounted at one end thereof on a lower end of the vertical support member so as to inwardly extend therefrom in a manner to be deviated, i.e. offset in the direction opposite to that of the point of force. The hanging hooks each include an insertion which is provided at a lower end thereof with a projection which projects toward the vertical support member and adapted to be inserted into an operating hole of the manhole cover in a manner to be eccentric with respect to the manhole cover lifting position of the apparatus. The manhole cover lifting position of the apparatus is deviated toward the press means, i.e. offset with respect to a line of the manhole cover on which the gravity of the manhole cover is placed.

The lever body may comprise a pair of lever members pivotally connected together at one ends thereof on the point of force side to permit the respective other ends thereof on a point of force side of the lever body to be approachable or accessible to each other, i.e. movable towards and away from each other, wherein the pivotal connection between both lever members is arranged at a position deviated or offset in the lateral direction from the gravity line of the manhole cover. The lever member each may be constructed to be foldable at a position thereof in the direction opposite to that of force applied to the point of force.

Alternatively, the lever body may comprises a single lever member and a pair of rods releasably connected to both ends of the lever member so that the lever body may be generally formed into a T-shape, the rods being arranged to be extendable with respect to the lever member.

Accordingly, it is an object of the present invention to provide an apparatus for operating and transferring a manhole cover which is capable of being effectively applicable to a manhole cover formed with any through-hole type operating hole including that of the pick-hole type.

It is another object of the present invention to provide an apparatus for operating and transferring a manhole cover which is capable of effectively preventing a manhole cover from being disengaged from the apparatus during the operation.

It a further object of the present invention to provide an apparatus for operating and transferring a manhole cover which is capable of preventing a swing phenomenon of a manhole cover and the application of torsion stress to a lever body and horizontally holding the manhole cover in a safe manner during the operation.

It is still another object of the present invention to provide an apparatus for operating and transferring a manhole cover which is capable of being foldable in a compact manner to facilitate the storing.

It is yet another object of the present invention to provide an apparatus for operating and transferring a manhole cover which is applicable to a manhole cover having an operating hole of the through-hole type formed away from an outer periphery of the manhole cover.

It is a still further object of the present invention to provide an apparatus for operating and transferring a manhole cover which is capable of accomplishing the above-noted objects with simple structure.

Yet another objects and advantages of the present invention will in part be obvious and will in part be apparent from the specification.

The present invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the present invention, reference is had to the following description taken in connection with the accompanying drawings in which like reference numerals designates like or corresponding parts throughout; wherein.

DETAILED DESCRIPTION OF THE PREFERRED EMBODIMENTS

Now, an apparatus for operating and transferring a manhole cover according to the present invention will be described hereinafter with reference to the accompanying drawings.

Figure 1:
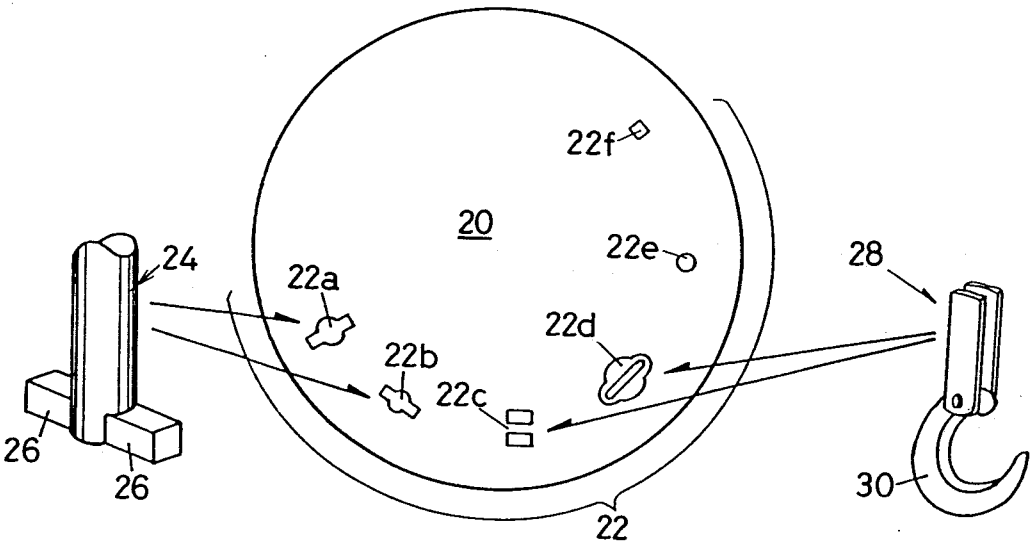
FIG. 1 is a schematic view showing various types of operating holes provided at a manhole cover and hanging hooks for operating the manhole cover through the operating holes.
Figure 2A:
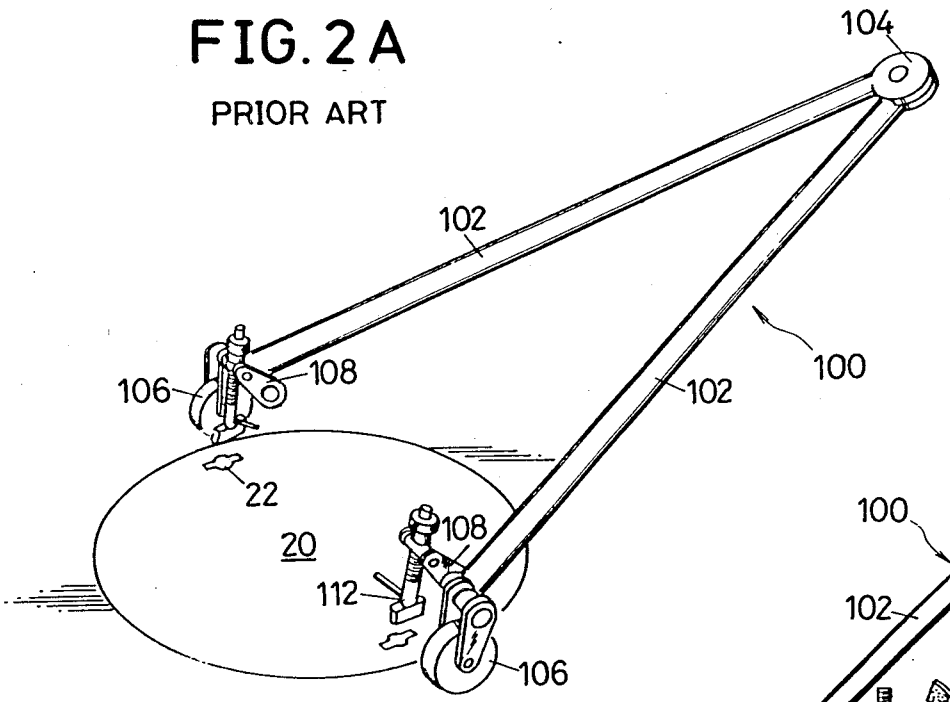
FIG. 2A PRIOR ART
FIG. 2A is a perspective view showing a conventional apparatus for lifting and transferring a manhole cover.
Figure 2B:
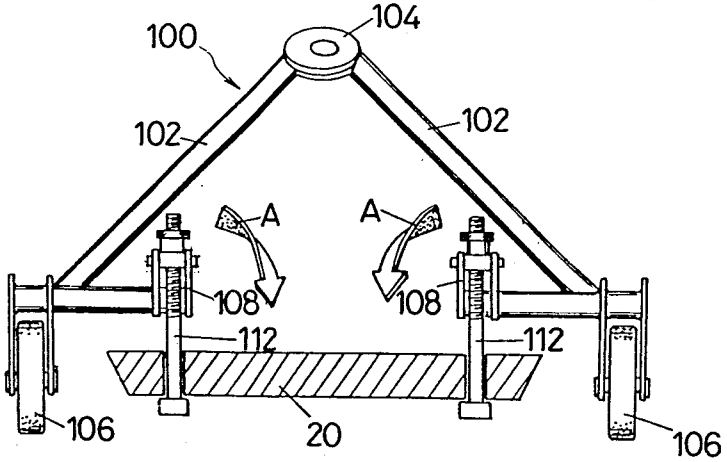
FIG. 2B PRIOR ART
FIG. 2B is a front view of the manhole cover lifting and transferring apparatus shown in FIG. 2A.
Figure 3:
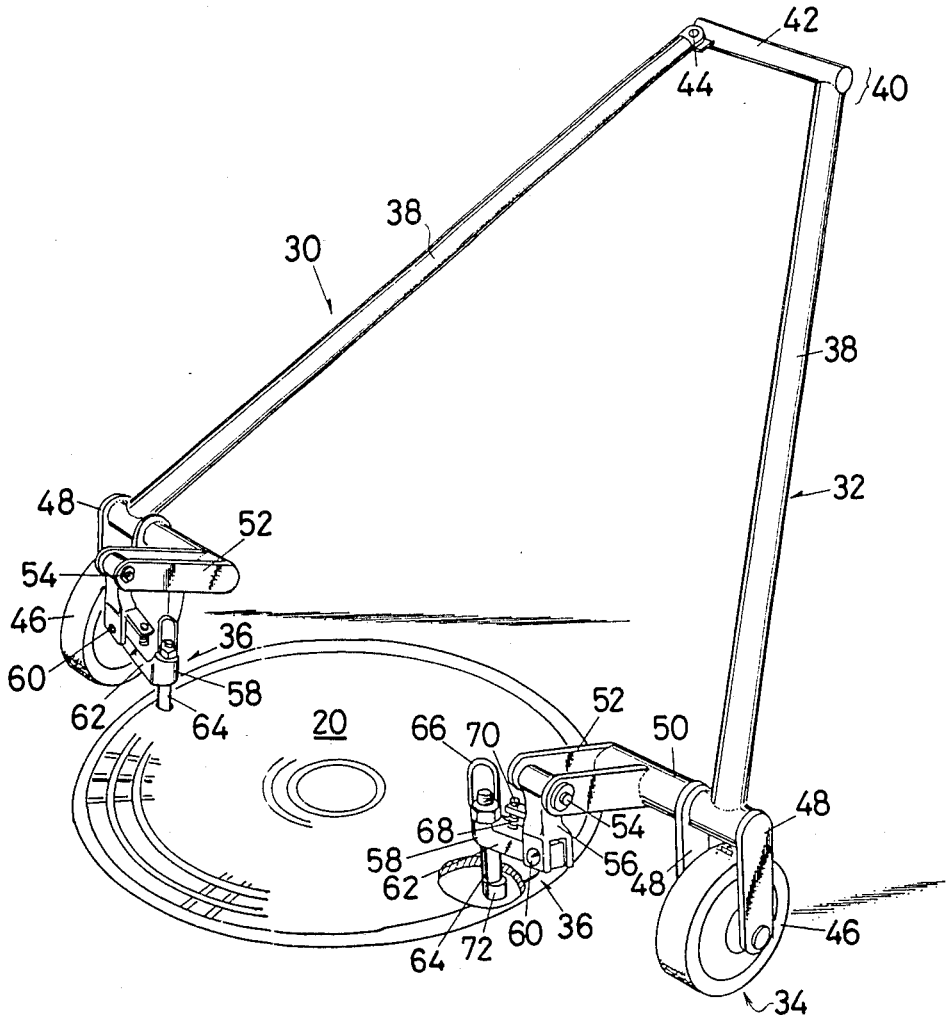
FIG. 3 is a perspective view showing an embodiment of an apparatus for operating and transferring a manhole cover according to the present invention.
Figure 4:
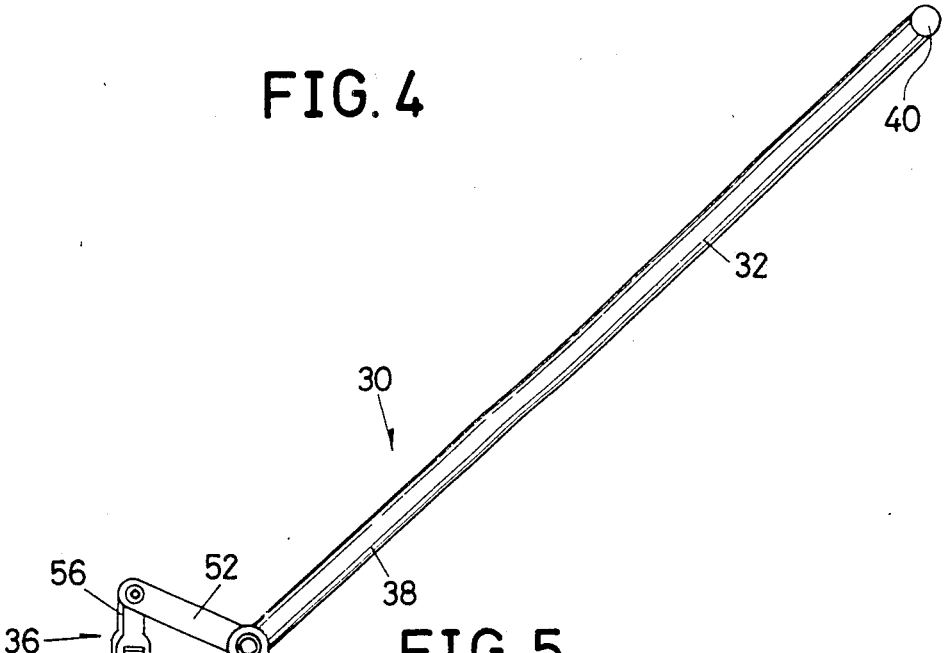
FIG. 4 is a side elevation view of the manhole cover operating and transferring apparatus shown in FIG. 3.
Figure 5:
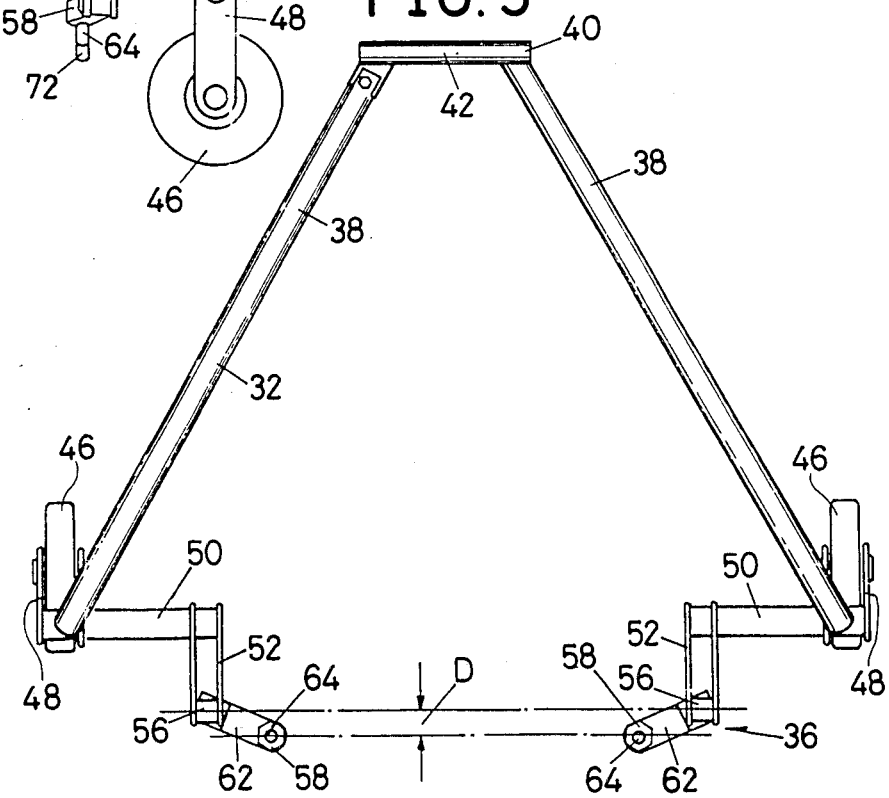
FIG. 5 is a plan view of the manhole cover operating and transferring apparatus shown in FIG. 3.

FIGS. 3 to 5 illustrate an embodiment of a manhole cover operating and transferring apparatus according to the present invention, wherein a manhole cover operating and transferring apparatus of the illustrated embodiment is generally designated by reference numeral 30. The apparatus generally comprises a lever body 32, wheel means 34 defining a point of support and and a pair of eccentric hanging hooks 36 which is adapted to directly hang a manhole cover 20.

The lever body 32 includes two lever members 38 which, in the illustrated embodiment, are horizontally pivotally connected at one end thereof on the side of a point of force 40 of the lever body 32 to each other, so that the other ends or free ends of the lever members 38 may be accessible to each other. In the illustrated embodiment, the connection between both lever members 38 on the side of the point of force 40 is carried out by pivotally connecting a grip portion 42 formed by bending the one end of one of the lever members 38 with the one end of the other lever member to form a pivotal connection 44 therebetween. Thus, the so-formed pivotal connection 44 is one-sided on the basis of the whole of the lever body 32. The lever body 32 may be formed of a suitable material such as, for example, a steel pipe or the like, so long as it has strength sufficient to act as a lever means which is capable of lifting the manhole cover 20.

The wheel means 34 is mounted on an end of the lever body 32 opposite to the point of force 40. In the illustrated embodiment, the wheels means 34 comprises a pair of wheel 46 each rotatably mounted on a distal end of a support fork member 48 connected at one end thereof to the other end of each of the lever members 38 so as to extend therefrom at an angle with respect to the lever member 38 in the longitudinal direction thereof. The support fork members 48, as shown in FIGS. 4 to 8, each have an extension 50 provided at the one end thereof so as to inwardly extend therefrom. The extensions 50 are provided at a distal end thereof with a pair of operating arms 52 of a forked shape. A pair of the operating arms 52 are arranged in a manner to be opposite to each other and project in the forward direction of the manhole cover operating and transferring apparatus of the illustrated embodiment. The operating arms 52 each are spaced from the associated wheel 46 by a distance sufficient to allow the hanging hook 36 mounted on a distal end of each of the operating arms 52 to be engaged with an operating hole 22 of the manhole cover 20 to lift the manhole cover in a state that the wheels are positioned at the outside of the manhole cover 20. For example, the operating arms 52 may be arranged at positions spaced from the corresponding wheels 46 by a distance sufficient to handle a manhole cover having operating holes arranged at an innermost position thereof, for example, at a position inwardly spaced by a distance of about 250 mm from an outer periphery of the manhole cover. In the illustrated embodiment, the lever members 38 and extensions 50 may be formed of a steel pipe and the support fork members 48 and operating arms 52 may be formed of a relatively flat metal material such as a steel plate or the like.

Now, the eccentric hanging hooks 36 will be described hereinafter with reference to the drawings, particularly, FIGS. 3 and 9 to 12.

Figure 6:
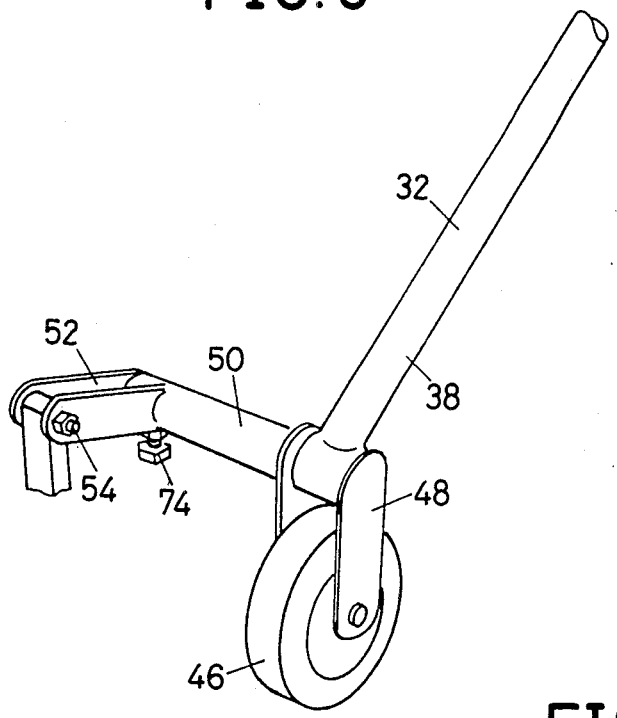
FIG. 6 is an enlarged perspective view showing a structure on the side of a point of application in the apparatus shown in FIG. 3.
Figure 7:
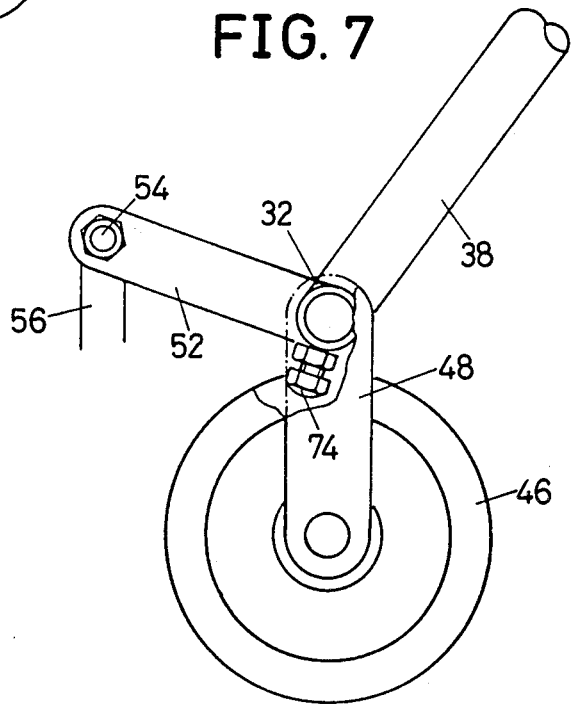
FIG. 7 is a side elevation view of the structure shown in FIG. 6.
Figure 8:
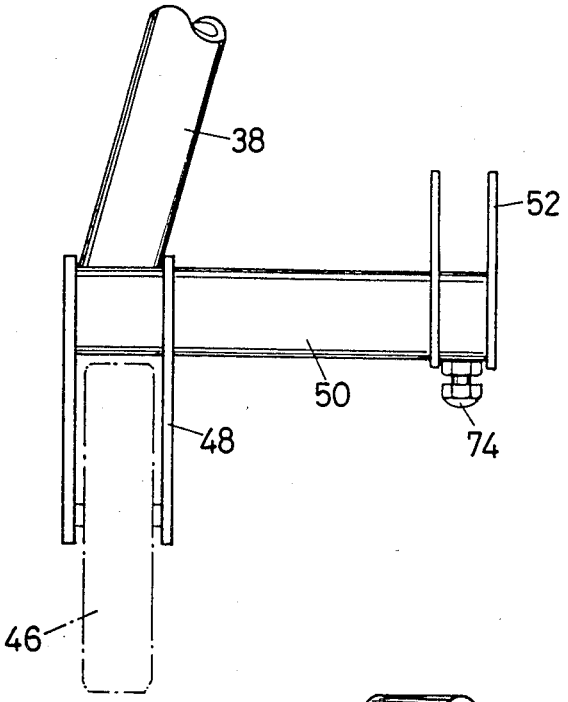
FIG. 8 is a rear view of the structure shown in FIG. 6.
Figure 9:
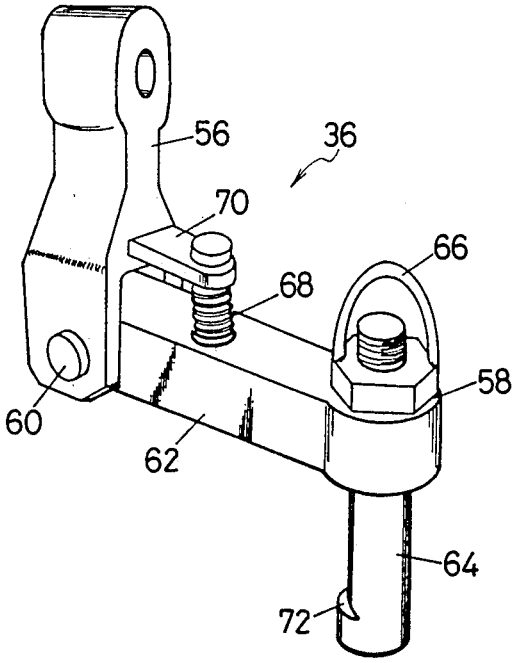
FIG. 9 is a perspective view showing a hanging hook.
Figure 10:
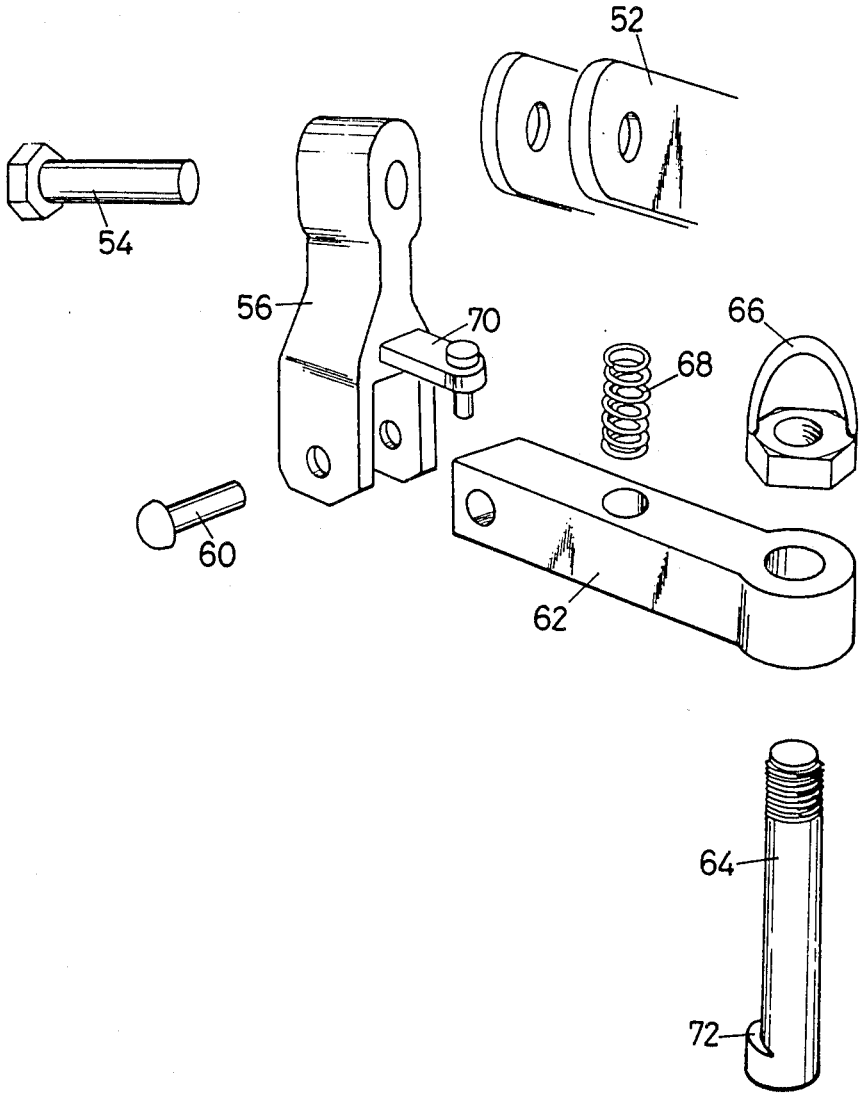
FIG. 10 is an exploded view of the hanging hook shown in FIG. 9.
Figure 11:
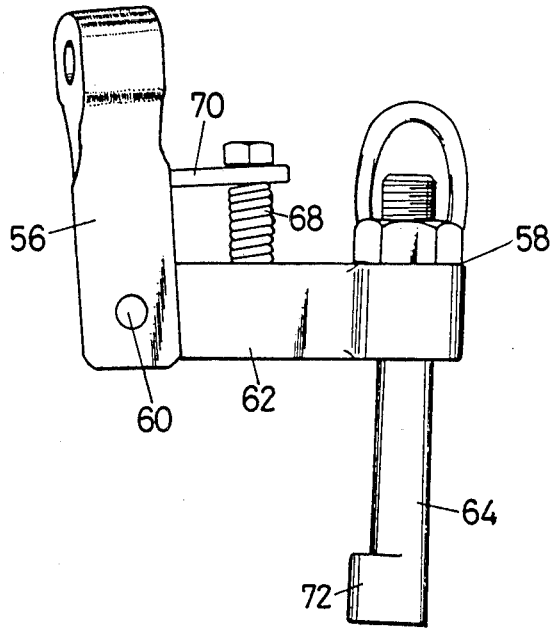
FIG. 11 is a side elevation view of the hanging hook shown in FIG. 9.
Figure 12:
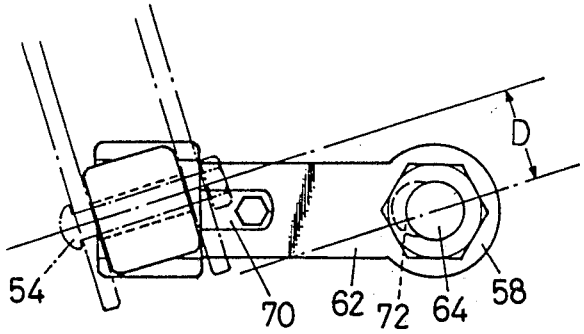
FIG. 12 is a plan view of the hanging hook shown in FIG. 9.

The eccentric hanging hooks 36 each are mounted through a connection pin 54 on a distal end of the operating arm 52. In the illustrated embodiment, each of the eccentric hanging hooks 36, as shown in FIGS. 9 to 12, comprises a vertical support member or connection member 56 of a block-like shape pivotally connected at an upper end thereof through the pin 54 to the operating arm 52 and a hanging member 58 movably mounted at an upper end thereof on a lower end of the support member 56. The vertical support members 56 each are somewhat twisted about the longitudinal axis to render a distal end of the hanging member 58 eccentric with respect to the position of the pin 54 provided at the operating arm 52, as shown in FIG. 11. More particularly, the vertical support member 56 is formed to permit the pin 54 positioned on the upper end thereof to be directed in the direction substantially parallel to the extension 50 and a pin 60 for connecting the lower end of the support member 56 to the hanging member 58 so that the hanging member 58 extends inwardly and away from the point of force of the lever member 32, i.e., so that the hanging member is directed in the direction somewhat deviated from that perpendicular to the pin 54. This, as shown in FIGS. 5 and 12, causes the hanging members 58 to be deflected by a distance indicated at reference character D ahead from a line formed by connecting both support members 56 together. The hanging members 58 each are generally formed into a substantially L-shape so as to have an extension arm 62 connected at one end thereof to the lower end of the support member 56 and an insertion 64 mounted at an upper end thereof on the other end of the extension arm 62 so as to downwardly extend therefrom. In the illustrated embodiment, the extension arm 62 and insertion 64 are formed integrally with each other. Reference numeral 66 designates a hanger mounted on the upper end of the insertion 64, through which the hanging member 58 is lifted. The hanging member 58 also includes a compressed spring 68 arranged between the extension arm 62 and a spring support member 70 mounted at an inner side surface of the vertical support member 56 so as to extend in parallel to the extension arm 62, so that the extension arm 62 may be downwardly biased by the spring 68 to extend in the direction somewhat downwardly slanted with respect to the direction perpendicular to the the vertical support member 56. Also, the insertion 64 is formed on the side of a lower end thereof facing the vertical support member 56 with a holding projection 72. Corresponding to the holding projection 72, the operating arm 52 or lever member 38 is provided with a press member 74 for pressing the manhole cover 20 lifted during the lifting operation, as shown in FIGS. 6 and 7. In the illustrated embodiment, the press member 74 comprises a bolt which has an adjustable length and is provided on a lower portion of the distal end of the extension member 50 to which the operating arm 52 is connected. The bolt constituting the press member 74 is preferably covered at a head portion thereof with an elastic material such as rubber or the like.

Now, the manner of operation of the manhole cover operating and transferring apparatus of the above-described embodiment illustrated in FIGS. 3 to 12 will be described with reference to FIGS. 13 and 14.

Figure 13A:
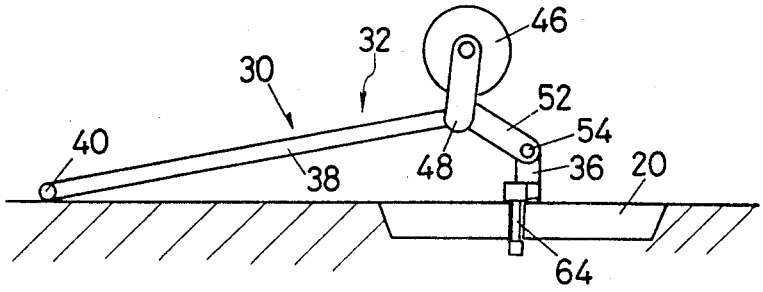
FIGS. 13A to 13E show the manner of operation of the manhole cover operating and transferring apparatus shown in FIGS. 3 to 5.
Figure 14A:
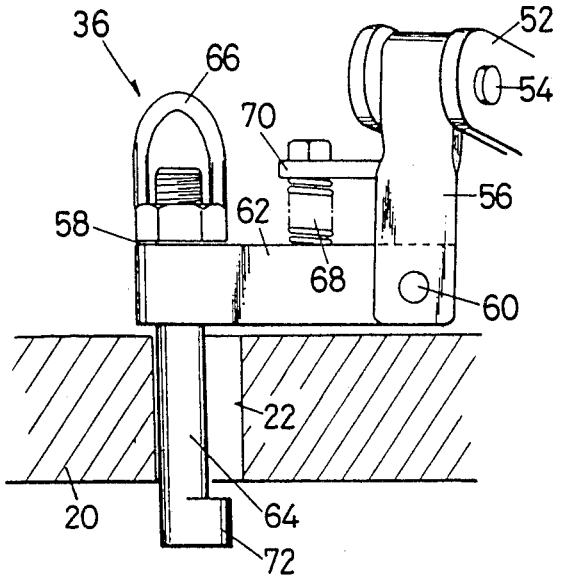
FIGS. 14A and 14B each show the operation of the eccentric hanging hook shown in FIGS. 9 to 12.
Figure 15:
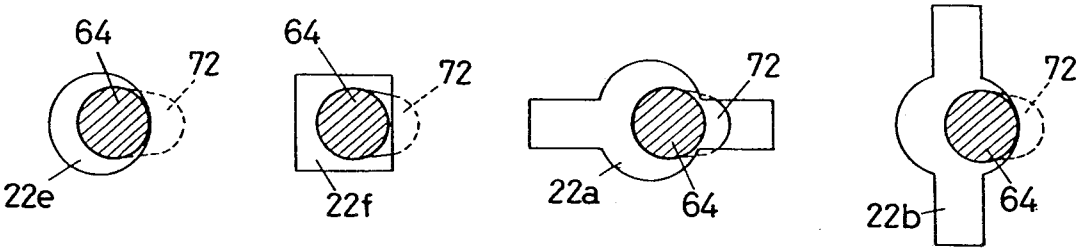
FIG. 15 is a schematic plan view showing the engagement between the hanging hook shown in FIGS. 9 to 12 and various operating holes of the through-hole type.

Insertion of eccentric hanging hook into manhole cover:

First, operation of moving the manhole cover operating and transferring apparatus 30 to a position at which a manhole cover 20 to be operated is placed and inserting the insertion 64 of each of the hanging members 58 into an operating hole 22 of the manhole cover 20 takes place. The operation is carried out by inverting the apparatus 30 to cause the insertion 64 to be hung and then inserting it into the operating hole 22 of the manhole cover 20, as shown in FIGS. 13A and 14A. It should be noted that in the present invention, the shape of the insertion 64, as shown in FIG. 15, allows the insertion to be inserted into all kinds of operating holes as indicated by reference numeral *22a, 22b, 22c* and *22d.*

Figure 13B:
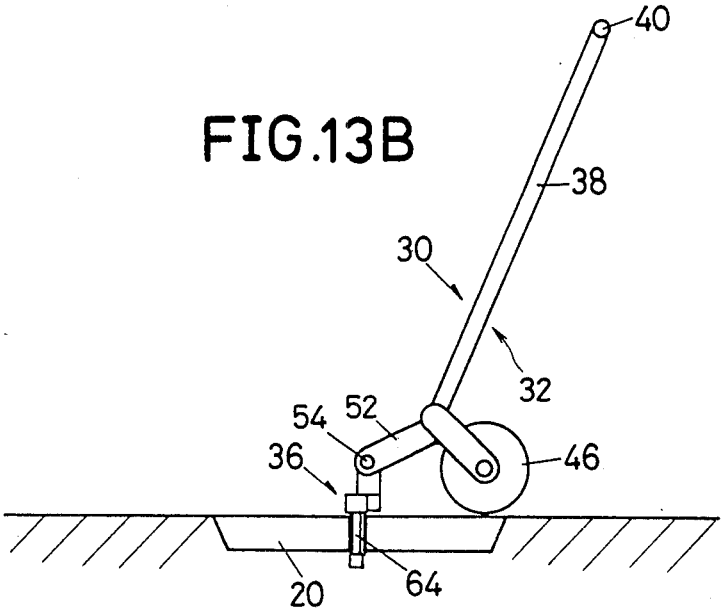
Figure 14B:
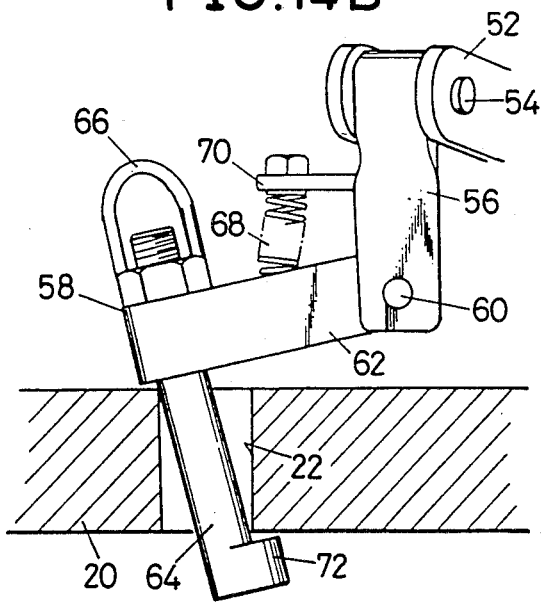

Engagement between eccentric hanging hook and manhole cover:

Then, the inverted apparatus is raised up as shown in FIG. 13B. This is carried out by rotating the lever body 32 about the pin 54 in the clockwise direction in FIG. 13A. This causes the wheels 46 acting as the point of support to be contacted with the ground and the distal end of each of the operating arms 52 to be raised about the point of support. This, as shown in FIG. 14B, results in the extension arm 62 of each of the hanging members 58 being raised at the one end thereof at which the pin 60 is provided, so that the insertion 64 may be somewhat slanted while it is inserted into the operating hole 22 of the manhole cover 20 to securely abut both sides thereof against upper end lower edges of the manhole cover 20, to thereby fixedly engage the hanging member 58 and the manhole cover 20 together. Such secure engagement between the two is promoted by the compressed spring 68, because it acts to force the extension arm 62 to press down the distal end of the arm. The above-described operation which is carried out by raising up the lever body 32 is convenient, however, the operation may be carried out using another procedure. For example, it may be carried out by inserting the insertion 64 of each of the hanging members 58 into the operating hole 22 of the manhole cover 20 while keeping the lever body 32 in a vertical state.

Figure 13C:
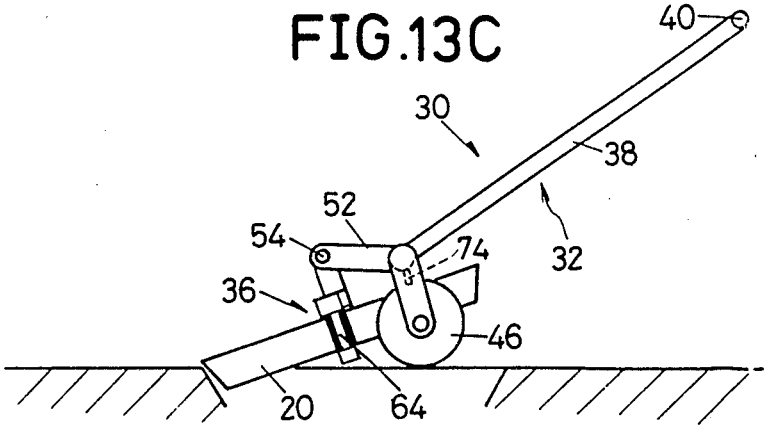
Figure 13D:
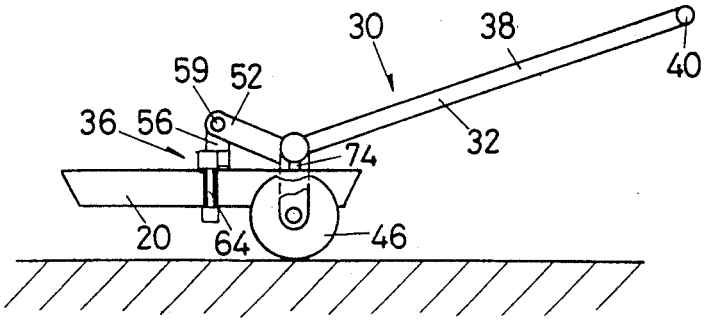

Drawing-up of manhole cover:

Then, the point of force 40 is further pressed down as shown in FIG. 13C, so that the operating arms 52 may be drawn up due to a lever action in which the wheels 46 serve as a point of support. In the illustrated embodiment, the lever body 32 and operating arms 52 may be formed to be, for example, about 1000 mm and 100 mm in length, respectively. Such dimensions allow force applied to point of force 40 to be increased by eight to ten times due to the lever action to more facilitate the starting of drawing-up or lifting of the manhole cover 20. When the drawing-up of the manhole cover starts, it is generally lifted not horizontally but obliquely. More particularly, the manhole cover 20 is lifted in a manner such that a portion thereof facing the lever body 32 of the apparatus 30 is at the upperside and a portion opposite thereto is at the lowerside. This is for the reason that the insertion 64 of each of the hanging members 58 is kept substantially integral with the manhole cover 20 during the lifting operation, so that the apparent central point for lifting the manhole cover which is a manhole cover lifting position of the apparatus 30 is not on a line obtained by connecting the operating holes 22 of the manhole cover 20 together but at a position on the manhole cover somewhat offset therefrom on the side of the point of force 40 of the lever body 32. Such a featured action is uniquely obtained by the eccentric hanging hooks 36 provided in the apparatus of the present invention. Thus, the eccentric hanging hooks 36 lift only one side of the manhole cover to cause the other side of the manhole cover to be on a support frame of a manhole, so that the weight on the other side of the manhole cover may be applied to the support frame. Thus, the manhole cover operating and transferring apparatus of the illustrated embodiment is not required to support the overall weight of the manhole cover. Subsequently, when the point of force 40 of the lever body 32 is further downwardly moved, the press member 74 provided at the base portion of each of the operating arms 52 is caused to be abutted against the upper surface of the manhole cover 20 to downwardly force the manhole cover 20. This results in the portion of the manhole cover placed on the support frame of the manhole cover 20 to be lifted due to a lever action wherein the vertical support members 56 of the eccentric hanging hooks 36 serve as a point of support, so that the manhole cover 20 may be horizontally lifted as shown in FIG. 13D. In this instance, the manhole cover 20 is lifted about a position thereof somewhat deviated or offset from a line obtained by connecting the vertical support members 56 together or the center of gravity of the manhole cover 20, so that the manhole cover may be apt to be generally obliquely lifted. However, in the illustrated embodiment, this is effectively prevented by a pair of the press members 74, as described above. Thus, the manhole cover 20 is lifted in a manner to be substantially integral with the apparatus 30 to a degree sufficient to prevent the abovedescribed swing phenomenon encountered with the prior art. Also, in the illustrated embodiment, the wheels 46 act as a point of support and a position of each lever member 38 at which the vertical support member is provided bears the weight of the manhole cover to generate moment which causes the lever member 38 to be inwardly twisted. However, the press members 74 are abutted against the upper surface of the manhole cover to effectively suppress the moment as described above, to thereby prevent the application of forcible torsion stress to the lever members 38.

As described above, the apparatus of the illustrated embodiment is adapted to carry out the operation of lifting the manhole cover 20 in which the position thereof deviated from the gravity line obtained by connecting the operating holes together is a lifting center of the manhole cover, so that it may be drawn up in an oblique manner. However, when a manhole cover having operating holes arranged at positions deviated from the gravity line is to be operated, the apparatus of the illustrated embodiment may be constructed in a manner such that the insertion 64 of the hanging member 58 is provided in the direction perpendicular to the corresponding vertical support member 56.

Transferring of manhole cover:

Subsequent to the drawing-up of the manhole cover from the support frame of the manhole, the apparatus 30 is moved to transfer the manhole to another place away from the manhole while keeping the manhole cover horizontal. Such movement of the apparatus is smoothly carried out by means of the wheels 46.

Figure 13E:
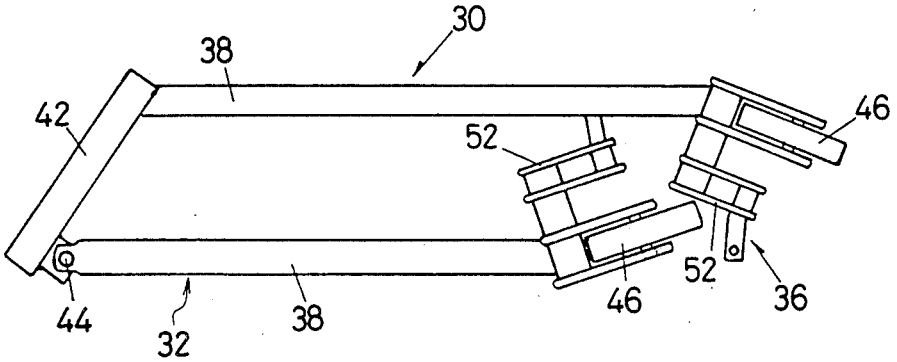

Storing of apparatus:

The storing of the apparatus after the use is readily accomplished by folding it at the pivotal connection 44 between the lever members 38 as shown in FIG. 13E. In this instance, the pivotal connection 44 is provided at the distal end of the grip portion 42 integrally connected to one of the lever members 38 so as to be biased on one side of the lever body 32. Accordingly, the folding of the lever body 32 permits the wheel 46 and eccentric hanging hook 36 mounted on the distal end of the lever member 38 free of the grip portion 42 to be positioned on the inside of the wheel 46 and eccentric hanging hook 36 of the other lever member 38 without abutting against them. Thus, the apparatus of the illustrated embodiment may be stored in a compact manner.

Figure 16:
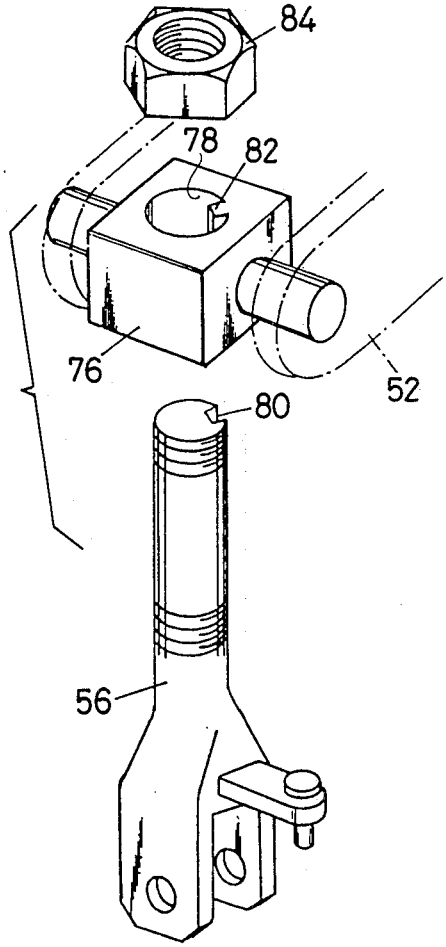
FIG. 16 is an exploded perspective view showing a modification of a vertical support member of a hanging hook.

In the illustrated embodiment described above, the vertical support member 56 of each of the eccentric hanging hooks 36 may be constructed in such a manner as shown in FIG. 16. A vertical support member 56 shown in FIG. 16 is adapted to be mounted on the distal end of the operating arm 52 through a pin block 76 fitted on the support member 56 via a through-hole 78. The direction of fitting between the support member 56 and the pin block 76 is regulated by a key groove 80 formed on the support member 56 and a projection 82 formed on the through-hole 78 of the pin block 76. Also, the pin block 76 is provided so as to be adjustable in the vertical direction with respect to the support member 56. More particularly, the vertical support member 56 is formed on an outer periphery thereof with a thread, so that a nut 84 may be threadedly engaged with a portion of the support member 56 projecting from the pin block 76 and vertically adjusted with respect to the support member 56.

Figure 17:
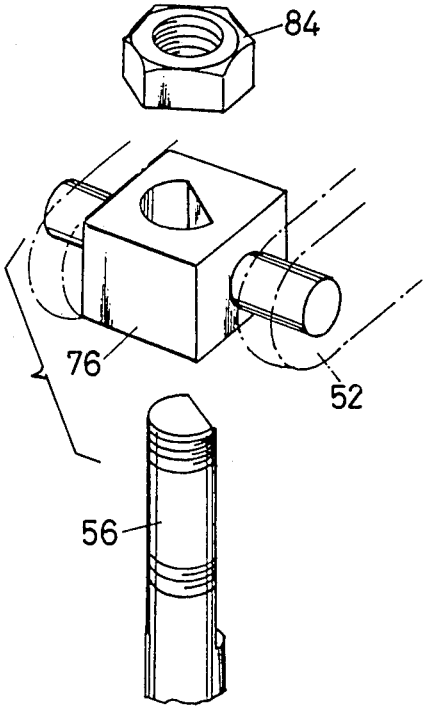
FIG. 17 is an exploded perspective view showing another modification of a vertical support member.

Alternatively, the vertical support member may be constructed as shown in FIG. 17. A vertical support member 56 shown in FIG. 17 is formed at a portion thereof on which a pin block 76 is fitted into a semicylindrical shape corresponding to a through-hole 78 of the pin block 76, so that the direction of engagement between the both may be regulated. The remaining part of the support member 56 shown in FIG. 17 is constructed in substantially the same manner as that shown in FIG. 16.

In the illustrated embodiment, the lever body 32 may be modified in such a manner as shown in FIGS. 18 or 19.

Figure 18A:
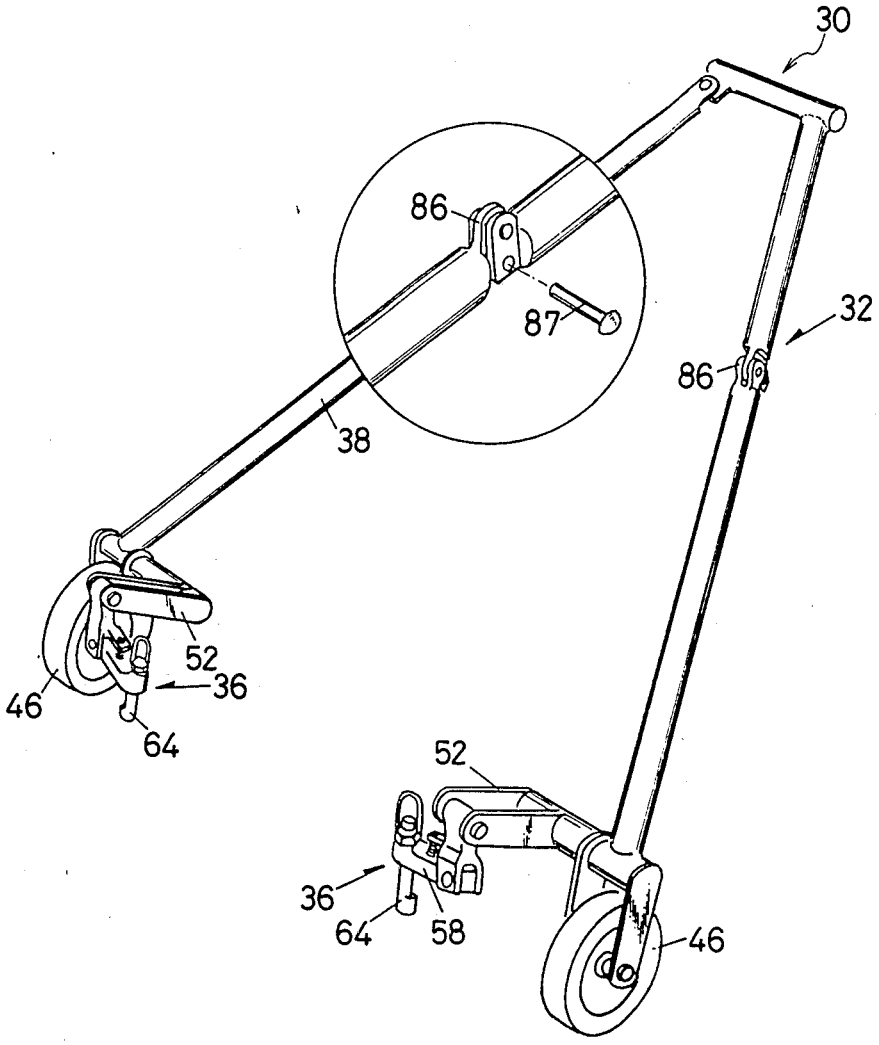
FIG. 18A is a partly enlarged perspective view showing a modification of a lever body.
Figure 18B:
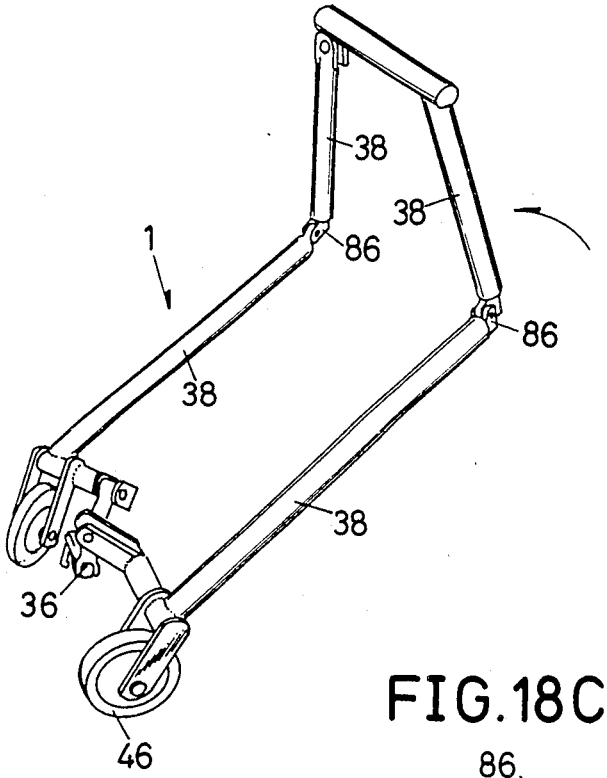
FIGS. 18B and 18C are perspective view showing the steps of folding of the lever body shown in FIG. 18A.
Figure 18C:
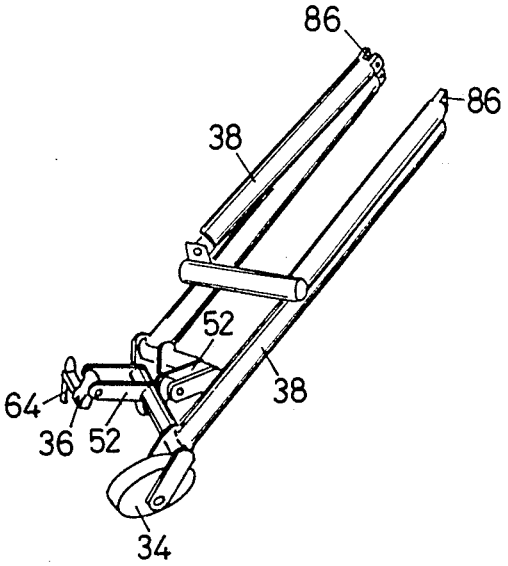

A lever body 32 shown in FIG. 18 is constructed to more facilitate the storing of the apparatus. More particularly, in the lever body 32, lever members 38 constituting the lever body 32 each are provided at a suitable position thereof with bendable portion 86 which is formed to be bent in the direction opposite to that in which force is applied to the point of force 40 during the operation of lifting a manhole cover, to thereby be foldable toward the wheel means side as shown in FIGS. 18B and 18C. Also, the bendable portion 86 is constructed to be rotatable by an angle of 180 degrees from the position of FIG. 18C at which the lever member is fully folded to that shown in FIG. 18A. Reference numeral 87 designates a set pin for keeping a posture of the lever member 38 horizontally extended.

Figure 19A:
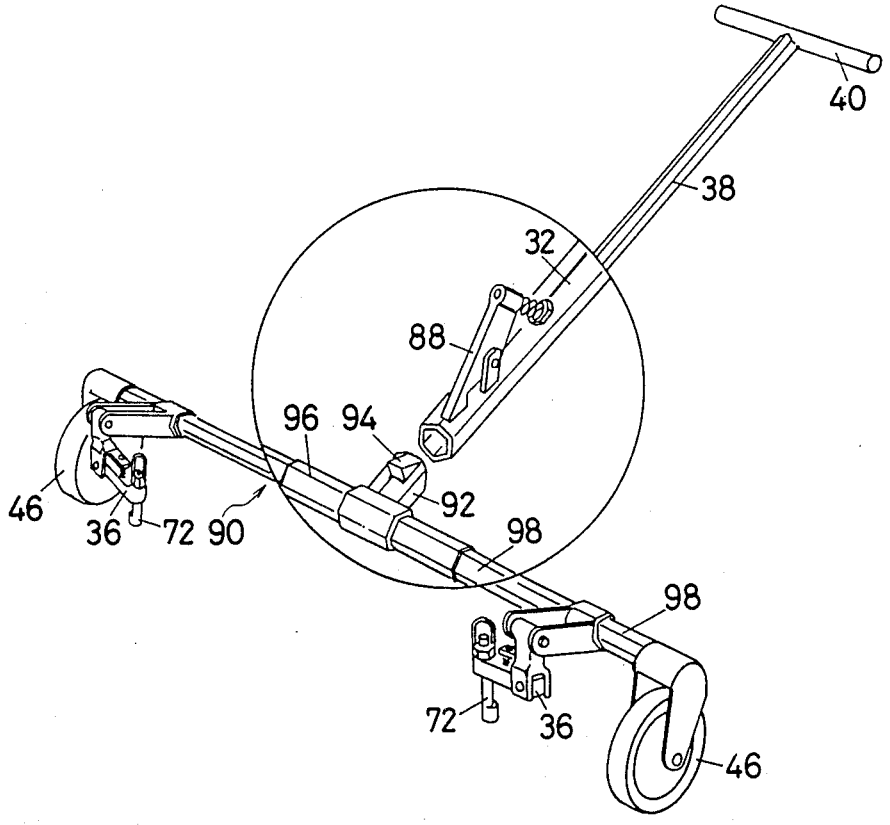
FIG. 19A is a partly enlarged perspective view showing another modification of a lever body.
Figure 19B:
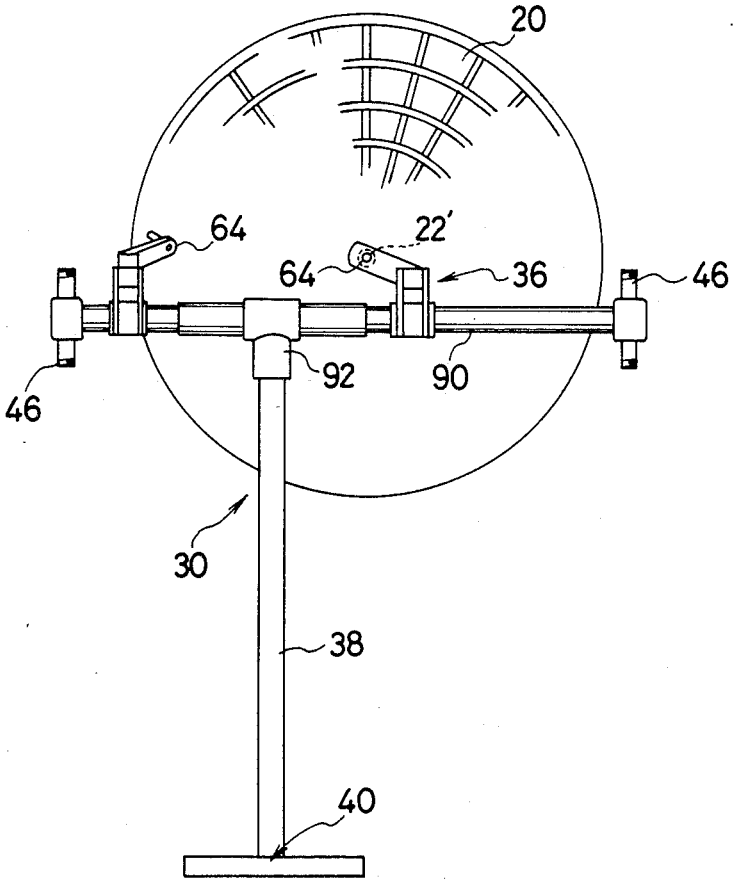
FIG. 19B is a plan view showing an example of use of the manhole cover operating and transferring apparatus having the lever body shown in FIG. 19A.

A lever body 32 shown in FIG. 19A is formed of a single lever member 38 provided at one end thereof with a hook member 88 and an extendable shaft member 90 for supporting wheels 34 at both ends thereof into a substantially T shape. The shaft 90 is connected at a middle portion thereof to the one end of the lever member 38. For this purpose, the shaft 90 is provided at the middle portion thereof with a tubular connecting member 92 having a holding means 94 mounted thereon which is adapted to be engaged with the inner recessed surface of the hook member 88 when the lever member 38 is inserted at the one end thereof on the connecting member 92, to thereby securely connect the one end of the lever member 38 therethrough with respect to the shaft member 90. In the illustrated embodiment, the shaft member 90 comprises a shaft body 96 on which the connecting member 92 is securely fitted and a pair of adjustable rods 98 nestedly connected relative to both ends of the shaft body 96 so as to be extendable relative to the shaft body 96, as shown in FIG. 19B. The wheels 46 each are mounted on an outer end of the adjustable rods 98 and the eccentric hanging hooks 36 each are arranged at a position on the rod 98 inside more than the wheel 46 so as to slidable on the shaft member 90.

The manhole cover operating and transferring apparatus 30 including the lever body 32 shown in FIG. 19A is effectively applicable to a manhole cover of a special form which has, for example, a single through-hole or operating hole 22' formed at a suitable position thereof such as a central position or the like, as shown in FIG. 19B, as well as the above-described one having two operating holes formed thereon opposite to each other. More particularly, the apparatus 30, as shown in FIG. 19B, is operated in a manner such that the connecting member 92 fitted on the shaft member 90 is moved together with the shaft body 96 to the left direction in FIG. 19B and the hanging hook 36 on the right side in FIG. 19B is slidably moved in close vicinity to the center of the shaft member 90, so that the insertion 64 of the hanging hook 36 is inserted into the operating hole 22'. The hanging hook 36 on the left side in FIG. 19B is not used. Accordingly, it is placed on the manhole in a manner such that the lower end thereof faces forwardly. Alternatively, the hanging hook 36 which is not used may be removed from the shaft member 90.

Thus, it will be noted that the manhole cover operating and transferring apparatus of the present invention is widely applicable to a manhole cover having any through-hole type operating hole including a pick-hole type one without changing the direction of the hanging hooks and/or exchanging the hanging hooks.

Also, the apparatus of the present invention ensures the secure engagement between the hanging hooks and a manhole cover to effectively prevent the manhole cover from being released from therefrom during the operation.

Further, the present invention is constructed in the manner that the position at which the hanging hooks are engagedly inserted into operating holes of a the manhole cover is deviated from the position at which the hanging hook lifts the manhole cover, so that the manhole cover may be lifted at the position deviated from its gravity; and the manhole cover is stably held on the side of the deviated position in a downwardly forced manner. Thus, the present invention effectively prevents a swing phenomenon of the manhole cover during the manhole cover lifting and transferring operation.

Such construction also prevents the application of torsion stress to the labor body. This requires the lever body to have only strength sufficient to resist flexural load applied thereto during the manhole cover lifting operation. Thus, the lever body in the present invention may be formed of a material of low strength and costs as compared with that in the conventional apparatus. This also permits the provision of a grip means at the lever body which is impossible in the conventional apparatus. Furthermore, this allows the lever body to be constructed to be foldable on the way thereof. Thus, the apparatus of the present invention significantly improves the workability and is readily stored in a compact manner.

It will thus be seen that the objects set forth above, and those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An apparatus for operating and transferring a manhole cover comprising:

a lever body having one end which defines a point of force;

wheel means rotatably mounted on the other end of said lever body so as to form a point of support;

a pair of operating arms mounted on said lever body so as to extend in the direction opposite to that in which said lever body is moved during the operation of lifting a manhole cover;

an eccentric hanging hook pivotally mounted on a distal end of each of said operating arms; and press means provided on one of said operating arms and lever body at a position away from said distal end of each of said operating arms so as to be abuttable against an upper surface of the manhole cover during the operation of lifting it;

said eccentric hanging hook comprising a vertical support member pivotally mounted at an upper end thereof on said distal end of each of said operating arms so as to be pivotally movable in the longitudinal direction of said apparatus and a hanging member mounted at one end thereof on a lower end of said vertical support member so as to extend inwardly therefrom and in a direction away from said one end of said lever body defining said point of force;

said hanging member including an insertion insertable into an operating hole of the manhole cover in a manner to be eccentric with respect to a manhole cover lifting position of said apparatus, said insertion being provided at a lower end thereof with a projection which projects toward said vertical support member;

said manhole cover lifting position of said apparatus being offset from a line of the manhole cover containing the center of gravity of the manhole cover and toward said press means.

2. An apparatus as defined in claim 1, wherein said lever body comprises a pair of lever members pivotally connected together at ends thereof on the side of said point of force to permit the other ends thereof on the side of a point of application of said lever body to be movable towards and away from each other, the pivotal connection between said lever members being positioned in a manner to be offset in the lateral direction from the gravity line of the manhole cover.

3. An apparatus as defined in claim 1, wherein said vertical support member is twisted about its longitudinal axis.

4. An apparatus as defined in claim 3, wherein said hanging hook comprises an extension arm connected at one end thereof to the lower end of said vertical support member so as to laterally inwardly extend therefrom and an insertion connected at an upper end thereof to the other end of said extension arm so as to downwardly extend therefrom and adapted to be inserted into an operating hole of the manhole cover.

5. An apparatus as defined in claim 4, wherein said insertion is provided at a side of a lower end thereof facing said vertical support member with a projection engagable with said operating hole of the manhole cover.

6. An apparatus as defined in claim 5, wherein said extension arm is biased elastic means so that the other end thereof may be downwardly forced.

7. An apparatus as defined in claim 6, wherein said elastic means comprise a compressed spring interposedly arranged between an upper surface of said extension arm and said vertical support member.

8. An apparatus as defined in claim 1, wherein said press means comprise a bolt mounted on a lower surface of said are operating, said bolt being vertically adjustable.

9. An apparatus as defined in claim 1, wherein said vertical support member is connected through a pin to said operating arm.

10. An apparatus as defined in claim 1, wherein said vertical support member is connected through a pin block to said operating arm.

11. An apparatus as defined in claim 1, wherein said lever body comprises a pair of lever members pivotally connected together at ends thereof on the side of said point of force to permit the other ends thereof on the side of a point of application of said lever body to be movable towards and away from each other, said lever member each being formed to be foldable at a suitable position thereof in the direction opposite to that of force applied to said point of force.

12. An apparatus as defined in claim 1, wherein said lever body comprises a pair of lever members pivotally connected together at ends thereof on the side of said point of force to permit the other ends thereof on the side of a point of application of said lever body to be movable towards and away from each other, said pivotal connection between said lever members being positioned in a manner to be offset in the lateral direction from the gravity line of the manhole cover, said lever members each being formed to be foldable at a suitable position thereof in the direction opposite to that of force applied to said point of force.

13. An apparatus as defined in claim 1, wherein said lever body comprises a single lever member and a pair of rods releasably connected to an end of said lever member so that said lever body is generally formed into a T-shape, said rods being arranged to be extendable with respect to said lever member.

14. An apparatus as defined in claim 1, wherein said hanging member is pivotally mounted on said vertical support member.

* * * * *